US005210376A

United States Patent [19]

Caviar

[11] Patent Number: 5,210,376

[45] Date of Patent: May 11, 1993

[54] SEALED ELECTRICAL CONNECTION DEVICE AND METHOD

[75] Inventor: Robert A. Caviar, Leawood, Kans.

[73] Assignee: Imperial Underground Sprinkler Co., Lenexa, Kans.

[21] Appl. No.: 782,801

[22] Filed: Oct. 25, 1991

[51] Int. Cl.[5] ..... H01R 4/22

[52] U.S. Cl. ..... 174/87; 29/871; 174/76; 174/82; 174/885

[58] Field of Search ..... 174/76, 87, 82, 885, 174/91, 93; 29/868, 871

[56] References Cited

U.S. PATENT DOCUMENTS

| | | | |
|---|---|---|---|
| 3,597,528 | 8/1971 | Penfield et al. | 174/87 |
| 3,810,078 | 5/1974 | Chordas | 174/84 C X |
| 3,869,189 | 3/1975 | McCurdy | 174/87 X |
| 3,937,870 | 2/1976 | Bumpstead et al. | 174/87 |
| 4,070,543 | 1/1978 | Thompson et al. | 174/87 |
| 4,491,686 | 1/1985 | Caviar | 174/87 |
| 4,874,909 | 10/1989 | Velke, Sr. et al. | 174/84 S |
| 5,099,089 | 3/1992 | Zan | 174/87 |

*Primary Examiner*—Morris H. Nimmo
*Attorney, Agent, or Firm*—Litman, McMahon & Brown

[57] ABSTRACT

A connecting device includes a body with an open end, a closed end and a body bore extending therebetween. A core includes an open end, a closed end and a core bore extending therebetween. The body bore is partly filled with potting compound in proximity to its closed end. The device has a closed position with the core inserted into the body bore and the core open end embedded in the potting compound to form a hermetically sealed pocket in the core bore. The body closed end has wire passages which receive wires therethrough. The wires are electrically connected in the sealed pocket. A method of connecting wires includes the steps of providing a body, providing a core telescopically receivable in the body, partly filling the body with potting compound, extending wires into the body and through the potting compound, connecting the wires, inserting the core into the body over the connected wires and forming a hermetically sealed pocket in the core bore.

16 Claims, 1 Drawing Sheet

SEALED ELECTRICAL CONNECTION DEVICE AND METHOD

BACKGROUND OF THE INVENTION

1. Field of the Invention

The present invention relates generally to electrical connectors, and in particular to a sealed electrical connection device and method.

2. Description of the Related Art

A variety of electrical connectors has heretofore been proposed for electrically conductively coupling components in electrical systems. For example, wires can be electrically coupled by soldering or twisting them together. Wire nuts are commonly used for twisting wire ends together. Wire connectors which attach by crimping are also available, and can include electrically conductive material for current flow between the wires.

In some applications it is desirable to seal or insulate the electrical connection from the elements to avoid corrosion of the metal conductive components and to avoid unintended grounding, shorting, etc. For example, electrical connectors are often used in outdoor and below-ground electrical systems where they can be exposed to precipitation, atmospheric humidity, corrosive soil conditions and ground water, all of which can contribute to unintended grounding and shorting. Electrical connections can be sealed against the elements by, for example, wrapping them in electrical tape or by otherwise enclosing them.

The Caviar U.S. Pat. No. 4,491,686 discloses an electrical connector which utilizes a potting compound within a cavity formed by a hollow core received within a hollow casing. The ends of a pair of wires can be twisted together for conduction and then potted in the hollow core with an insulating sealant, such as silicon.

Heretofore there has not been available an electrical connection device and method with the advantages and features of the present invention.

SUMMARY OF THE INVENTION

In the practice of the present invention, an electrical connection device is provided which includes a body with open and closed ends and a body bore extending therebetween. A plurality of wire passages are formed in the body closed end. The body has a sidewall with a generally cylindrical configuration.

A core includes open and closed ends and a core bore extending therebetween. The core has a core sidewall with a generally cylindrical configuration and a prong assembly with a pointed tip for opening the wire passages. The prong assembly also includes a shaft for slidably engaging a groove in the body sidewall whereby the core is aligned with respect to the body. The core includes a pair of locking lugs which are received in a pair of detents in the body sidewall for locking the core in the body bore. The body bore includes an inner portion adjacent to its closed end which is filled with potting compound. The core open end is embedded in the potting compound when the core is inserted in the body bore whereby a sealed air pocket is formed in the core bore. A crimp sleeve is located within the air pocket and electrically conductively connects the ends of a plurality of wires which are inserted through the wire passages and the potting compound and into the air pocket.

In the practice of the method of the present invention, an electrical connection is made by inserting wires through the wire passages in the body closed end, electrically conductively connecting them with the crimp sleeve, and enclosing the crimp sleeve and the connected ends of the wires in an air pocket formed in the core bore by inserting the core into the body bore to place the device in a closed position with the air pocket hermetically sealed by the potting compound in the body bore.

OBJECTS AND ADVANTAGES OF THE INVENTION

The principle objects and advantages of the present invention include: providing a sealed electrical connection device; providing such a device which includes a body and a core which are telescopically interconnectable; providing such a device which has a closed position with the core thereof lockingly snapped into the body; providing such a device which can be prefilled with potting compound; providing such a device with a hermetically sealed pocket in its closed position; providing such a device wherein electrical wires can be connected in the pocket thereof; providing such a device wherein the pocket is adapted to receive an electrical crimp connector; providing such a device which is usable in various ambient conditions, including damp and humid conditions; providing such a device which is adaptable for use with various numbers and sizes of wires; providing such a device which is relatively heat resistant; providing such a device which can withstand temperatures of several hundred degrees fahrenheit; providing such a device which is adapted for locking relatively securely in its closed position; providing such a device which allows for oversizing wire passage holes in its body while still maintaining an effective seal around the wires; providing such a device with a potting compound which is compatible with electrical wire coatings; providing such a device which is economical to manufacture, efficient in operation, capable of a long operating life and is particularly well adapted for the proposed usage thereof; providing a method of making a sealed connection; providing such a method that is efficient; providing such a method which can be accomplished with few, if any, tools; and providing such a method which accommodates and allows for the correction of oversized wire passage holes.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

I. Introduction and Environment

Figure 1:
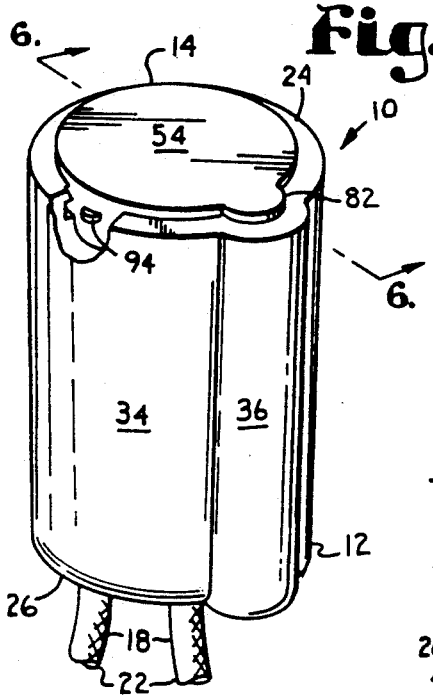
FIG. 1 is an upper, perspective view of a sealed electrical connection device embodying the present invention, shown in a closed position thereof.
Figure 2:
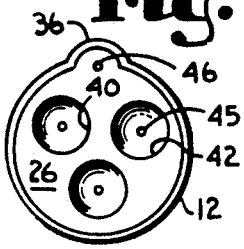
FIG. 2 is a bottom plan view thereof.
Figure 3:
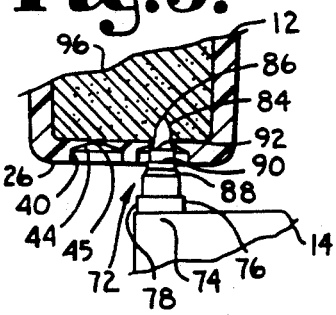
FIG. 3 is a fragmentary, vertical, cross-sectional view thereof, showing a wire passage membrane being holed by a prong assembly thereof.
Figure 4:
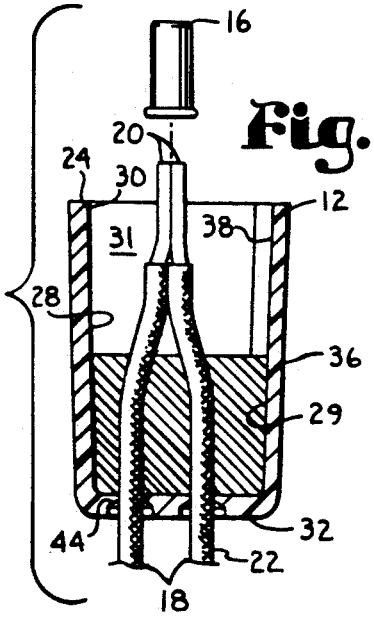
FIG. 4 is a fragmentary, vertical, cross-sectional view thereof, particularly showing the connector body with wires inserted therethrough and positioned for receiving a crimp connector.
Figure 7:
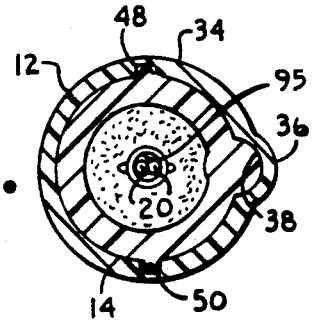
FIG. 7 is a horizontal, cross-sectional view thereof, taken generally along line 7—7 in FIG. 6.
Figure 5:
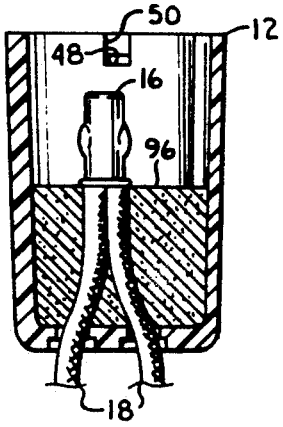
FIG. 5 is a fragmentary, vertical, cross-sectional view thereof, particularly showing the wires and crimp connector pulled back into engagement with potting compound within the body.
Figure 6:
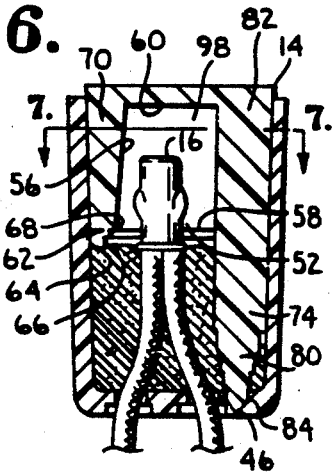
FIG. 6 is a vertical, cross-sectional view thereof, showing the device in its closed position, taken generally along line 6—6 in FIG. 1.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, the reference numeral 10 generally designates an electrical connection device embodying the present invention. The device 10 generally comprises a body 12, a core 14 and a connector or crimp sleeve 16.

Without the limitation on the generality of useful applications of the present invention, it is shown electrically conductively connecting or coupling a pair of electrical wires 18 with bare ends 20 and strippable insulation 22.

II. Body 12

The body 12 includes a first or open end 24, a second or closed end 26, and a closed-end body bore 28 open at said body open end 24 and closed at said body closed end 26 whereby a mouth 30 is formed at said body open end 24 and an end wall 32 is formed at s id body closed end 26. The body 12 further includes a sidewall 34 with an outwardly-projecting ridge 3 extending longitudinally from end-to-end and forming a channel 38 which opens inwardly to the body bore 28. The ridge 36 projects radially outwardly from the body sidewall 34 and extends longitudinally between the body ends 24, 26.

The body end wall 32 includes a plurality (three are shown) of wire passages 40 each having a recess 42 open at the body closed end 26 and an outwardly-concave/inwardly-convex membrane 44 spaced inwardly from a respective recess 42. Each membrane 44 includes a central orifice 45. A relief hole 46 is formed in the end wall 32 in alignment With the channel 38. The body bore 28 includes an inner portion 29 adjacent to the body closed end 26 and an outer portion 31 adjacent to the body open end 24.

A pair of detents 48 are formed in the sidewall 34 in diametrically opposed relation across the body bore 28. The detents 48 are open to the body bore 28 and are spaced slightly inwardly from the body open end 24. A pair of lug guide slots 50 extend inwardly from the body open end 24, each lug guide slot 50 communicating with a respective detent 48. The lug guide slots 50 converge slightly inwardly as they extend from the body open end 24 to the detents 48.

III. Core 14

The core 14 includes a first or open end 52 and a second or closed end 54. The core 14 includes a core bore 56 extending from and open at a core mouth 58 formed at the core open end 52 to a core end wall 60 formed at the core closed end 54.

At the core mouth 58, the core open end 52 can be beveled, as at 62, to form a relatively sharp edge 64. Outer and inner annular steps 66, 68 encircle the core bore 56 in proximity to the mouth 58 and are formed in a sidewall 70 of the core 14.

A prong assembly 72 includes a prong shaft 74 formed on one side of the core sidewall 70 with the shaft 74 protruding both inside and outside the sidewall 70 to form inner and outer core ridges 76, 78. The shaft 74 extends from a shaft first end 80 terminating slightly beyond the core open end 52 to a shaft second end 82 at the core end wall 60. A prong tip 84 extends outwardly from the shaft first end 80 and is coaxially aligned with the shaft 74. The prong tip 84 includes a point 86 and first, second and third annular, coaxial steps 88, 90 and 92 with progressively larger diameters. The core 14 includes a pair of locking lugs 94 extending outwardly from the core sidewall 34 in diametrically opposed relation with respect to each other and in slightly spaced relation inwardly from the core closed end 54.

IV. Connector or Crimp Sleeve 16

The connector or crimp sleeve 16 can comprise an electrically conductive material, such as copper, and is hollow with a wire end receiver 95 for receiving the bare wire ends 20. The material comprising the crimp sleeve 16 is preferably malleable whereby the crimp sleeve 16 can be crimped or compressed, for example with pliers or a similar compression-type crimping tool, to complete an electrical connection of the wires 18 therethrough.

As an alternative to the crimp sleeve 16, the bare wire ends 20 can be electrically connected or coupled by wire nuts, by soldering, or by twisting them together.

V. Construction and Operation

The body and the core 14 can be formed of any suitable material, such as molded, high grade, ultraviolet resistant engineering grade plastic. The body bore inner portion 29 can be prefilled with a suitable potting compound 96, such as silicon insulation/sealant. The depth of the potting compound 96 and its quantity should be sufficient to embed the core open end 52 therein when the connection device 10 is in a closed position thereof whereby an air pocket 98 is formed within the core bore 56. The air pocket 98 is thus substantially sealed.

The wire passages 40 are preferably opened to slidably receive the wires 18. The wire passages 40 can be opened to various diameters by piercing the membranes 44 with the prong tip 84 to depths which place respective prong tip steps 88, 90 or 92 through the membrane 44. The prong tip 84 is designed to provide progressively greater diameters for the wire passages 40 by inserting it through the membranes 44 to progressively greater depths. The membrane central orifices 45 receive the prong tip point 84, and the outwardly-concave configurations of the membranes 44 facilitate guiding the prong tip 84 through the centers of the wire passages 40.

The membranes 44 can be relatively thin for further expansion, if necessary, when the wires 18 are pushed therethrough and can comprise a "memory" type of plastic for clamping onto the wires 18. The wires 18 are also pushed through the potting compound 96 to positions where their bare ends 20 are positioned outside of the body open end 24. The wire ends 20 can be stripped of the insulation 22 either before or after passing the wires 18 through the wire passages 40. The wires 18 are then electrically coupled, for example with the crimp sleeve 16. The wires 18 can then be pulled back through the body 12 slightly to position the crimp sleeve 16 within the air pocket 98, i.e., in proximity to the potting compound 96. With the crimp sleeve 16 properly positioned, the core 14 can be telescopically inserted into the body bore 28 to place the connection device 10 in its closed position. The outer ridge 78 of the shaft 74 provides an alignment means in cooperation with the body sidewall channel 38 during the closing procedure.

The core 14 is inserted until its end wall 60 is substantially flush with the body open end 24. The core lugs 94 are slidably received in the lug guide slots 50, which also facilitate alignment. The body 12 can be slightly elliptically deformed adjacent to its open end 24 as the lugs 94 traverse the lug guide slots 50. The lugs 94 are received in the detents 48 with the connection device 10 in its closed position whereby the core 14 can "snap" into place when fully inserted in the body 12.

With the device 10 in its closed position, the prong tip 84 extends partly into the relief hole 46 and the core open end 52 is embedded in the potting compound 96. The air pocket 98 is thus substantially sealed against air infiltration. The flexible nature of the potting compound 96 tends to form a relatively long term, relatively fluid-tight seal between the wires 18 and the potting compound 96, whereby the sealed integrity of the air pocket 98 is preserved.

The body end wall 32 can have various numbers of wire passages 40, whereby various numbers of wires 18 can be coupled with the device 10. The various components of the device 10 can be sized to accommodate different sizes of wires 18 with different current capacity ratings.

It is to be understood that while certain forms of the present invention have been illustrated and described herein, it is not to be limited to the specific forms or arrangement of parts described and shown.

What is claimed and desired to be secured by Letters Patent is as follows:

1. An electrical connection device, which comprises:

(a) a body with an open end, a closed end and a body bore open at said body open end and terminating at said body closed end;

(b) wire passage means for passing an electrical wire through said body and into said bore;

(c) body closure means for enclosing at least a portion of said body bore; and (d) potting compound placed in said body bore prior to enclosure of said body bore by said body closure means, the amount of said potting compound being sufficient to cover a portion of said wire while leaving a sealed air pocket in said body bore after enclosure by said body closure.

2. The invention of claim 1, which includes:

(a) said bore having an inner portion adjacent the closed end thereof and an outer portion adjacent the open end thereof;

(b) said potting compound being located in said bore inner portion; and (c) said body closure means comprising a core with an open end, a closed end and a core bore open at said core open end and closed at said core closed end, said device having a closed position thereof with said core in said body bore and said core open end engaging said potting compound while leaving said air pocket between said core open end and said core closed end.

3. The invention of claim 2, which includes:

(a) locking means for locking said device in its closed position.

4. The invention of claim 3 wherein said core locking means comprises:

(a) a lug on one of said core and said body; and (b) a detent on the other of said core and said body, said detent receiving said lug with said core in its closed position.

5. The invention of claim 1 wherein:

(a) said wire passage means includes a membrane which is pierceable to form a wire opening in said body.

6. The invention of claim 5 wherein said wire passage means includes:

(a) a pair of recesses in said body selectively covered by a pair of said pierceable membranes.

7. The invention of claim 6 wherein:

(a) said body includes an end wall at said closed end thereof; and (b) said recesses are located in said body end wall.

8. A connection device having an open and a closed position, which comprises:

(a) a body including a closed end, an open and a body bore open at said body open end and closed at said body closed end;

(b) a pair of passages in said body closed end;

(c) a core including a core open end, a core closed end and a core bore open at said core open end and closed at said core closed end;

(d) said body bore having an inner portion adjacent to its closed end and an outer portion adjacent to its open end;

(e) potting compound placed in said body bore inner portion when said connection device is in said open position; and (f) said closed position being achieved when said core is telescopically received in said body bore and said core open end embedded in said potting compound and a sealed pocket formed in said core bore between said core open end and said core closed end.

9. The invention of claim 8 wherein each said passage is covered by a pierceable membrane.

10. The invention of claim 9 wherein each said passage includes an externally accessible recess and a respective membrane positioned adjacent to said body bore.

11. The invention of claim 8, which includes:

(a) locking means for locking said bore in said body with said device in its closed position.

12. A device for electrically connecting at least a pair of wires each including a bare end and an insulation covering, which comprises:

(a) a generally cylindrical body including:

(1) an open end and a mouth at said open end;

(2) a closed end and an end wall at said closed end;

(3) a body bore extending from said body closed end to said body open end, said body bore being closed at said body closed end open at said body mouth;

(4) a generally cylindrical body sidewall;

(5) a ridge extending radially outwardly from said body sidewall and extending longitudinally between said body ends, said ridge forming a sidewall groove open inwardly to said body bore;

(6) a pair of detents in said body sidewall and open to said body bore, each said detent being positioned in closely-spaced proximity to said body open end;

(7) a pair of lug guide grooves positioned diametrically opposite each other across said body bore and open to said body bore, each said lug guide slot extending from said body mouth to a respective detent;

(8) a plurality of wire passages formed in said body end wall and extending from said body closed end to said bore, each said wire passage including a memory plastic membrane with an outwardly concave/inwardly convex configuration with a center aperture;

(9) each said wire passage having a recess open at said body end wall and terminating at a respective membrane;

(10) a relief hole in said end wall generally aligned with said sidewall groove;

(11) a body bore inner portion adjacent to said body end wall; and

(12) a body bore outer portion adjacent to said body mouth;

(b) a generally cylindrical core, which includes:

(1) an open end;

(2) a closed end;

(3) a core bore extending from said core closed end to said core open end;

(4) a core end wall at said core closed end;

(5) a core mouth at said core open end;

(6) a core sidewall with a generally cylindrical configuration surrounding said core bore and extending between said core ends;

(c) said core including a prong assembly having:

(1) a shaft integral with said core sidewall and forming an inner ridge projecting radially inwardly from said core sidewall into said core bore and an outer ridge projecting radially outwardly from said core sidewall radially, said shaft extending from said core closed end to said core open end;

(2) a shaft first end positioned in proximity to said core open end and a shaft second end positioned in proximity to said core closed end; and (3) a prong tip coaxially mounted on said shaft first end and including a distal point and a plurality of annular steps whereat said prong tip has progressively greater diameters;

(d) a pair of lugs extending radially outwardly from said core sidewall in proximity to said core open end, said lugs being positioned in diametrically-opposed relation across said core;

(e) a quantity of potting compound sufficient to partially fill said body bore inner portion, said compound placed in said body bore inner portion when said connector device is in an open position with said body and said core separated;

(f) a crimp sleeve including a wire end receiver; and (g) the connector device also having a closed position with the wires each extending through a respective wire passage and the potting compound, the bare wire ends crimped in the crimp sleeve, and the core received in the body bore with the prong assembly outer shaft received in the body groove, the prong distal point received in the body end wall relief hole, each lug received in a respective detent and a sealed air pocket formed between said core closed end and said core open end.

13. A method of electrically connecting at least a pair of wires, each wire having a bare end and an insulation layer, which comprises the steps:

(a) providing a connector body with an open end, a closed end and a body bore extending between said ends;

(b) providing multiple wire passages in said body closed end;

(c) partially filling an inner portion of said body bore adjacent to said closed end with potting compound;

(d) inserting said wires through a respective wire passage and through said potting compound whereby said wire bare ends extend beyond said body open end;

(e) providing a crimp sleeve with a receiver;

(f) placing said wire ends in said crimp sleeve receiver;

(g) crimping said crimp sleeve on said wire ends;

(h) retracting said wires to position said crimp sleeve within said body bore;

(i) providing a core with an open end, a closed end and a core bore extending between said core ends;

(j) inserting said core open end into said body bore;

(k) telescopically advancing said core into said body bore;

(l) embedding said core open end in said potting compound;

(m) forming a sealed air pocket within said core bore between said core open end and said core closed end; and (n) enclosing said crimp sleeve in said sealed air pocket.

14. The invention of claim 13, which includes the additional steps of:

(a) providing said core with a prong assembly;

(b) covering said wire passages with membranes; and (c) piercing said wire passage membranes with said prong assembly.

15. The invention of claim 14, which includes the additional steps of:

(a) providing a groove in said body sidewall open to said body bore;

(b) providing said prong assembly with a ridge protruding radially outwardly from said core sidewall and extending between said core ends;

(c) aligning said ridge with said groove; and
(d) slidably passing said ridge into said groove as said core is inserted into said body bore.

16. The invention of claim 13, which includes the additional step of:

(a) providing a detent-and-lug locking mechanism; and
(b) locking said core within said body with said detent-and-lug locking mechanism.

* * * * *